US006488277B2

(12) United States Patent
Herrmann

(10) Patent No.: US 6,488,277 B2
(45) Date of Patent: Dec. 3, 2002

(54) SHEET SEPARATION MECHANISM

(75) Inventor: Ricardo Ramirez Herrmann, Jalisco (MX)

(73) Assignee: Hewlett-Packard Company, Palo Alto, CA (US)

( * ) Notice: Subject to any disclaimer, the term of this patent is extended or adjusted under 35 U.S.C. 154(b) by 135 days.

(21) Appl. No.: 09/814,395

(22) Filed: Mar. 19, 2001

(65) Prior Publication Data

US 2002/0130459 A1 Sep. 19, 2002

(51) Int. Cl.[7] ..... B65H 3/30

(52) U.S. Cl. ..... 271/22; 271/21; 271/24; 271/124

(58) Field of Search ..... 271/19, 21, 22, 271/24, 104, 121, 124, 126, 167, 170

(56) References Cited

U.S. PATENT DOCUMENTS 4,463,943 A * 8/1984 Deconinck ..... 271/115
5,150,892 A * 9/1992 Shimizu ..... 271/104

FOREIGN PATENT DOCUMENTS

JP 61-18645 * 1/1986 ..... B65H/1/26

* cited by examiner

*Primary Examiner*—Donald P. Walsh
*Assistant Examiner*—Kenneth W Bower

(57) ABSTRACT

A sheet separating device having a mechanism for buckling or humping a top sheet of a stack and thereby separating the top sheet from an underlying sheet that may be adhering to the underside of said top sheet.

20 Claims, 4 Drawing Sheets

SHEET SEPARATION MECHANISM

BACKGROUND OF THE INVENTION

1. Field of the Invention

The present invention relates generally to hard copy sheet processing apparatus. More specifically, it is concerned with mechanisms for separating successive sheets of stacked print media before they are fed into a sheet processing device.

2. Description of Related Art

Automated business machines for producing or reproducing hard copy documents (such as inkjet printers, electrophotographic printers, impact printers, copiers, facsimile machines, document scanners and the like) usually include (or are otherwise associated with) an automatic sheet feeder mechanism. Such mechanisms automatically unload successive single sheets from a stack of said sheets and then direct them to a workstation where a printing, copying, scanning, etc. apparatus carries out its intended function upon them.

Unfortunately, individual sheets in a stack of print media (such as a stack of paper) sometimes adhere to one another. This adherence has several causes: electrostatic charge between abutting sheets, sheet-to-sheet surface friction, chemical reactions between abutting sheets and/or the presence of edge debris on a stack of sheets. Regardless of the reason for it, when two or more sheets of print media adhere to one another, they constitute a misfeed into a sheet processing device.

Many sheet feeding mechanisms, and especially paper feeding mechanisms, operate by developing a frictional force between a sheet pickup device (such as a pad or roller) and the uppermost sheet in a stack of said sheets. The pad or roller is usually in physical contact with the top side of the top sheet in the stack. A frictional force between the pickup device and the top sheet causes the top sheet to be pulled off the stack and out of its holding tray when the sheet pickup pad or roller is moved forward in a linear movement and/or when a roller type pickup device is rotated while it is in contact with the top sheet. A stack of sheets from which successive top sheets are withdrawn also is usually held in pressure contact with the pickup device by the action of an upwardly directed biasing device such as a spring. Such a device urges a tray upon which the stack rests in an upward direction toward the paper pickup device. Thus, when the tray becomes empty, its bottom will come into direct contact with the paper pickup device. This circumstance can be used to generate a signal to reload the tray with a new stack of sheet stock. To this end, the tray is then moved downward against the upwardly directed force of the spring and reloaded.

Certain operational problems are associated with machines that include such automatic sheet feeders. The two most common problems are "paper jams," and "multiple sheet feeds". Paper jams interrupt sheet feed operations and require manual correction of the jam before automated conveyance of the paper can be restarted. That is to say that when a paper jam occurs, operation of the printer, copier, scanner, etc. must go into a standstill mode while waiting for a human operator to correct the problem. In this standstill mode, the operator has to first confirm the location of the paper jam and then remove the jam, usually by removing a sheet of paper lodged somewhere in the machine's paper transport path.

Multiple sheet feed problems occur when two or more sheets of print media such as paper adhere to one another.

Such adhering sheets often cause jams. Jams caused by multiple sheet feeds have the same undesirable consequences as jams having other causes. They also require the same kinds of manual clearing operations. Multiple sheet misfeeds also create pagination errors whereby adhering pages are not included in a sequenced array of pages because they were not sequentially printed, copied, scanned, etc. in an expected manner.

SUMMARY OF THE INVENTION

The present invention provides a sheet separating mechanism that serves to minimize the previously described multiple sheet feed problems and, hence, the jamming and improper pagination problems associated with them. The sheets being processed by applicant's sheet separating mechanism will usually be print media such as paper. Those skilled in this art will, however, appreciate that other flexible (i.e., capable of being buckled or humped in a manner hereinafter described), sheet-like, materials can be separated just as well by the mechanisms described in this patent disclosure. Some of the more important components of applicant's sheet separating mechanisms comprise: (1) a tray for containing a stack of sheets such as sheets of paper, (2) a sheet pickup arm having a sheet contact device for driving a top sheet of the stack in a forward direction, (3) a stopper wall capable of being placed in a substantially vertical orientation (to oppose forward movement of a top sheet) and in a substantially horizontal orientation (to allow forward movement of a top sheet) and (4) first and second sheet elevation stopper bars for defining the size and location of a hump in a top sheet by virtue of it being driven forward by the sheet contact device while being opposed by the stopper wall while it is in its vertical orientation.

Optionally, the sheet separating mechanism of this patent disclosure may further comprise a sheet takeup device into which the top sheet is fed when the stopper wall is lowered to its substantially horizontal orientation. In some still more preferred embodiments of this invention, applicant's sheet separating mechanism will further comprise a sheet pickup arm that is equipped with a device having a configuration which is such that it is capable of powered rotation while in contact with the top surface of a top sheet. Pickup devices have round, elliptical, triangular and starwheel configurations that can perform this function. Pickup devices having round configurations are somewhat preferred. Hence, they will be used as the primary example in the specifications and drawings of this patent disclosure. In any case, powered rotation of such a pickup device can also serves to drive the top sheet forward. This powered rotation of a pickup device can be actuated before, during or after the forward driving action produced on the top sheet by a linear forward movement of the sheet pickup arm.

Other preferred embodiments of applicant's sheet separating mechanism will include a sheet stack hold down device. Such a sheet stack hold down device is capable of upward and upward motion with respect to a given sheet in a stack as that sheet becomes the "top" sheet in the stack. Preferably, the hold down device is lifted upward and out of contact with a top sheet just before said top sheet is driven forward by the forward movement of the sheet pickup arm. The hold down device is then lowered into contact with the next highest sheet in the stack so that it is not moved forward along with the top sheet. Still another preferred embodiment of this sheet separation mechanism will include a powered lift tray that automatically raises a stack as successive top sheets are removed from it.

The present invention serves to prevent, or at least thwart, multi-sheet misfeeds. It does this by imparting a sheet buckling or humping action to a forwardly moving top sheet—and to an underlying sheet that is adhering to the bottom surface of the top sheet—and to a sheet adhering to the bottom of the underlying sheet, and so on. Again, this forward motion can be imparted to the top sheet by virtue of it being in contact with a friction-creating pickup device (e.g., a pad, foot, roller, etc.) that is attached to a pickup arm that is capable of moving in a forward direction and then returning to its starting position at the appropriate time in the overall operation of this mechanism. Thus, as the pickup arm moves forward, it moves the top sheet forward as well. And as was previously noted, this forward movement of the top sheet can be augmented by (indeed, even entirely replaced by) powered rotation of a round, elliptical, triangular, starwheel, pickup device that is placed in physical contact with successive top sheets to be moved forward. Thus, a forwardly moving top sheet (and any underlying sheet(s) adhering to it) collide(s) with a vertical wall and, as a result thereof, is humped upward in its (their) center region(s). The hump is created between two bars that serve to define the location, contour and physical limits of the hump. that is capable of moving in a forward direction and then returning to its starting position at the appropriate time in the overall operation of this mechanism. Thus, as the pickup arm moves forward, it moves the top sheet forward as well. And as was previously noted, this forward movement of the top sheet can be augmented by (indeed, even entirely replaced by) powered rotation of a round, elliptical, triangular, starwheel, pickup device that is placed in physical contact with successive top sheets to be moved forward. Thus, a forwardly moving top sheet (and any underlying sheet(s) adhering to it) collide(s) with a vertical wall and, as a result thereof, is humped upward in its (their) center region(s). The hump is created between two bars that serve to define the location, contour and physical limits of the hump.

DETAILED DESCRIPTION OF THE INVENTION

Figure 1:
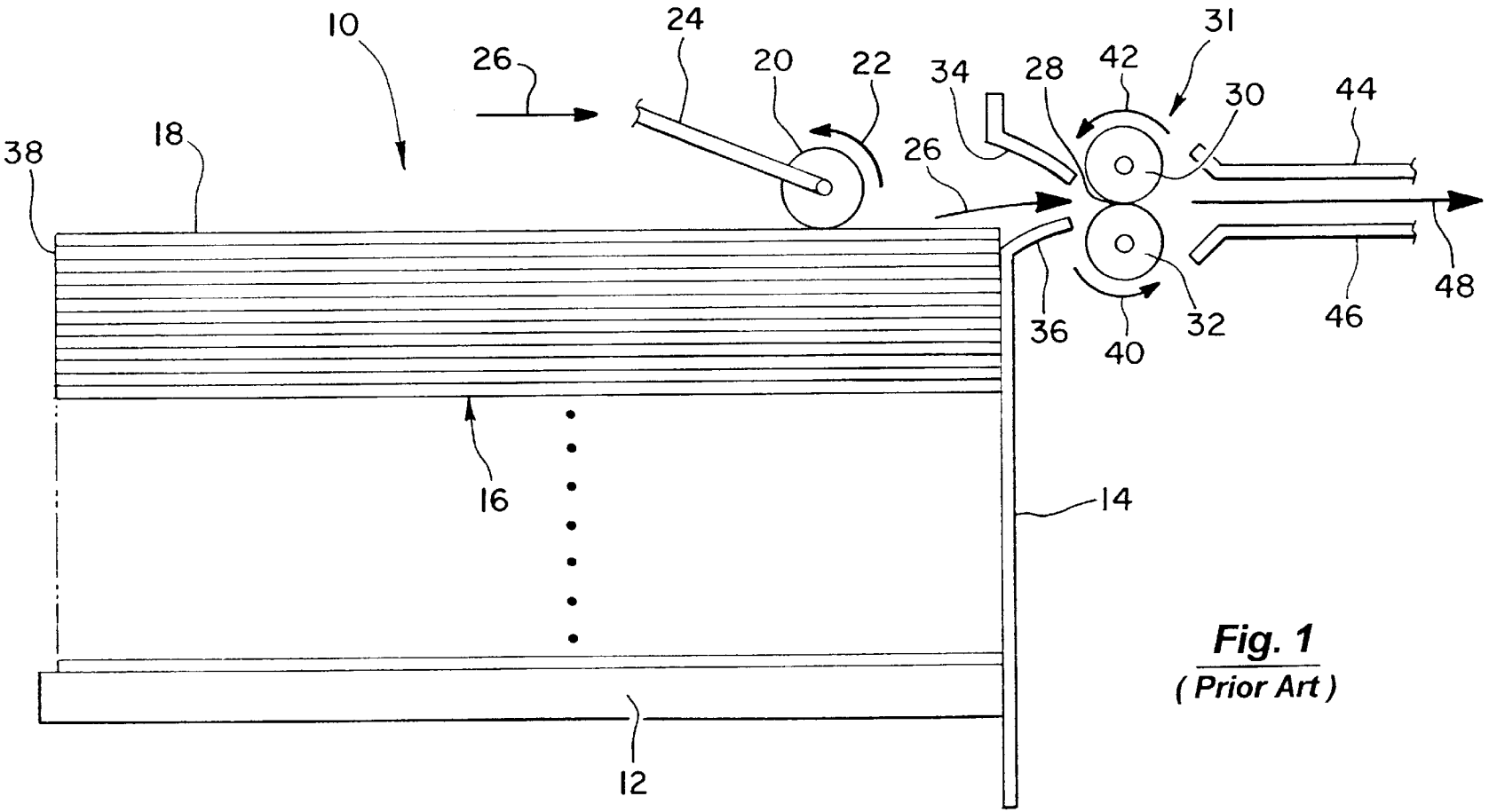
Fig. 1 (Prior Art)
FIG. 1 depicts a cut-away side view of a prior art sheet feeder having several features in common with the feeder of the present patent disclosure.

FIG. 1 depicts a prior art print media (e.g., paper) sheet separating device 10. It has a powered lift tray 12 and a fixed front wall 14. A stack 16 of print media such as sheets of paper is shown positioned on the lift tray 12. This stack 16 includes a top sheet 18. A highly generalized pickup roller 20 is shown contacting the top side of the top sheet 18. A motor (not shown) transmits a torque to the pickup roller 20 via a clutch mechanism (not shown) which rotates the pickup roller 20 in the counterclockwise direction suggested by arrow 22. The pickup roller 20 is attached to a pickup roller arm 24 that is capable of motion in the forward direction generally suggested by arrow 26. Thus, the forward motion 26 of the pickup roller arm 24 and the counterclockwise rotation of pickup roller 20 itself can each serve to feed a topmost sheet 18 in the forward direction 26 that eventually leads to a roller nip 28 of a sheet takeup mechanism 31. The pickup roller 20 is then removed from contact with the top surface of the top sheet 18 and placed in contact with a succeeding top sheet (i.e., underlying sheet 38 which becomes a succeeding top sheet 18).

FIG. 1 also illustrates how such a forwardly moving top sheet 18 is first channeled into the nip 28 of a feed roller 30/retard roller 32 interface of the sheet takeup mechanism 31. This channeling action can be brought about (at least in part) by virtue of the fact that a top paper path guide 34 at the left end of the sheet takeup mechanism 31 is slanted downward toward the nip 28 while a bottom paper path guide 36 is slanted upward said nip 28. This prior art sheet separating device 10 works well enough when the pickup roller 20 feeds only the top sheet 18 into the nip 28.

Unfortunately, individual sheets in any given stack 16 of print media sometimes adhere to one another. Again, such adherence may be due to electrostatic charge, paper-to-paper surface friction and/or the presence of paper edge debris. Thus, a sheet 38 residing just under the top sheet 18 can be dragged to the nip 28 along with the top sheet 18 by the forward movement 26 of arm 24 and/or by rotation of roller 20 in the counterclockwise direction suggested by arrow 22. Indeed, several succeeding underlying sheets may be dragged to the nip 28 along with the top sheet 18. This type of multiple sheet misfeed occurs often enough that most prior art paper sheet feed devices provide a mechanism for dealing with the problem.

For example, FIG. 1 shows the feed device 10, or a sheet takeup mechanism 31 associated with it, provided with a retard roller 32 which, as its name implies, serves to retard forward movement of any underlying sheet 38 that is in fact adhering to the underside of the top sheet 18. During normal, (i.e., single sheet) feed operations, the feed roller 30 rotates in a counterclockwise direction 42 that serves to convey a single top sheet 18 in the forward direction 26 that passes through the nip 28. When there is only one sheet between the feed roller 30 and the retard roller 32, the torque on the feed roller 30 is relatively larger than the torque on the retard roller 32. Hence, the retard roller 32 is driven in a clockwise direction which is in mechanical harmony with the counterclockwise rotation of the feed roller 30. Thus, a single sheet 18 passes between the two harmoniously cooperating rollers 30 and 32. This harmonious action feeds a single top sheet 18 between a top guide 44 and a bottom guide 46 of the sheet takeup mechanism 31 in the forward direction generally indicated by arrow 48. This movement serves to deliver a single top sheet 18 to a printer, copier, scanner or facsimile machine that will further operate upon the top sheet 18.

The retard roller 32 also is provided with a clutch (not shown) which enables it to cease rotating in a clockwise direction and commence rotating "backwards" i.e., in the counterclockwise direction 40 suggested in FIG. 1. This counterclockwise rotation 40 of retard roller 32 only takes place when more than one sheet is presented to the nip 28. This counterclockwise rotation 40 is in friction-creating mechanical conflict with the counterclockwise rotation 42 of feed roller 30. In effect, it opposes sheet movement in the forward direction suggested by arrow 26. When two or more sheets are erroneously delivered to the nip 28 between feed roller 30 and retard roller 32, the feed roller torque becomes relatively smaller than a reverse torque delivered to the retard roller 32. As a result, the retard roller 32 is rotated in a reverse direction 40 (e.g., counterclockwise). Friction occurring between the topmost sheet 18 and an adhering second sheet 38 is smaller than friction occurring between the top sheet and the feed roller 30. This circumstance reduces the torque transmitted from the feed roller 30 to the retard roller 32. Therefore, in a multiple sheet misfeed situation, the retard roller 32 rotates in the same counterclockwise direction as the feed roller 30. Consequently, a sheet 38 that is adhering to the underside of a top sheet 18 is pushed back toward the feeding tray 12. Hence, only the topmost sheet 18 is fed through the nip 28 of the sheet takeup mechanism 31.

There is, however, a drawback to this operation. It revolves around the fact that, after the retard roller 32 has pushed back an adhering underlying sheet 38, the retard roller 32 is no longer operating in mechanical harmony with the counterclockwise rotation 42 of the feed roller 30. This conflict results in a great deal of friction between the respective surfaces of the rollers. This friction is detected, and then alleviated, so that the retard roller 32 can again be made to rotate in mechanical harmony with the feed roller 30 so that the formerly rejected underlying sheet 38 can then be fed in feeding direction 26 during a second forward conveyance of said sheet 38.

This second forward conveyance can, for example, be brought about by counterclockwise 22 of roller 20. Thus, whenever there is a multisheet type misfeed, the retard roller 32 is called upon to switch from rotating in the feeding direction (e.g., clockwise), to rotating in the reverse direction (e.g., counterclockwise) and then back to the original (clockwise) mode of rotation. The torque reaction(s) of such switching actions causes direct shock to, and vibration of, the retard roller 32. This shock and vibration are transmitted to the feeding roller 30 and/or to its drive shaft. These undesired actions may cause mechanical wear, noise and possible damage. Worse yet, the friction-creating interaction between the surface of the feed roller 30 and the surface of the retard roller 32 (when the retard roller 32 is driven in the counterclockwise direction 40) most certainly causes both roller surfaces to wear out much faster than they otherwise would. This circumstance also implies that the rollers 30/32 will wear out much faster than the remainder of the paper processing device (printer, scanner, facsimile machine, etc.) with which they are associated. For example, such rollers 30/32 may last for about 350 thousand sheets in a typical printer while the expected life of that same printer may well be on the order of 1 to 2 million sheets. This implies that the rollers 30/32 will have to be replaced from about 3 to about 6 times during the operating life of the printer. Moreover, if these roller replacements are not made when they are needed, the retard roller 32 action will no longer prevent multiple sheet misfeeds and the entire printer will be perceived by an end user as being problematic and/or of low reliability, quality, etc.

Figure 2:
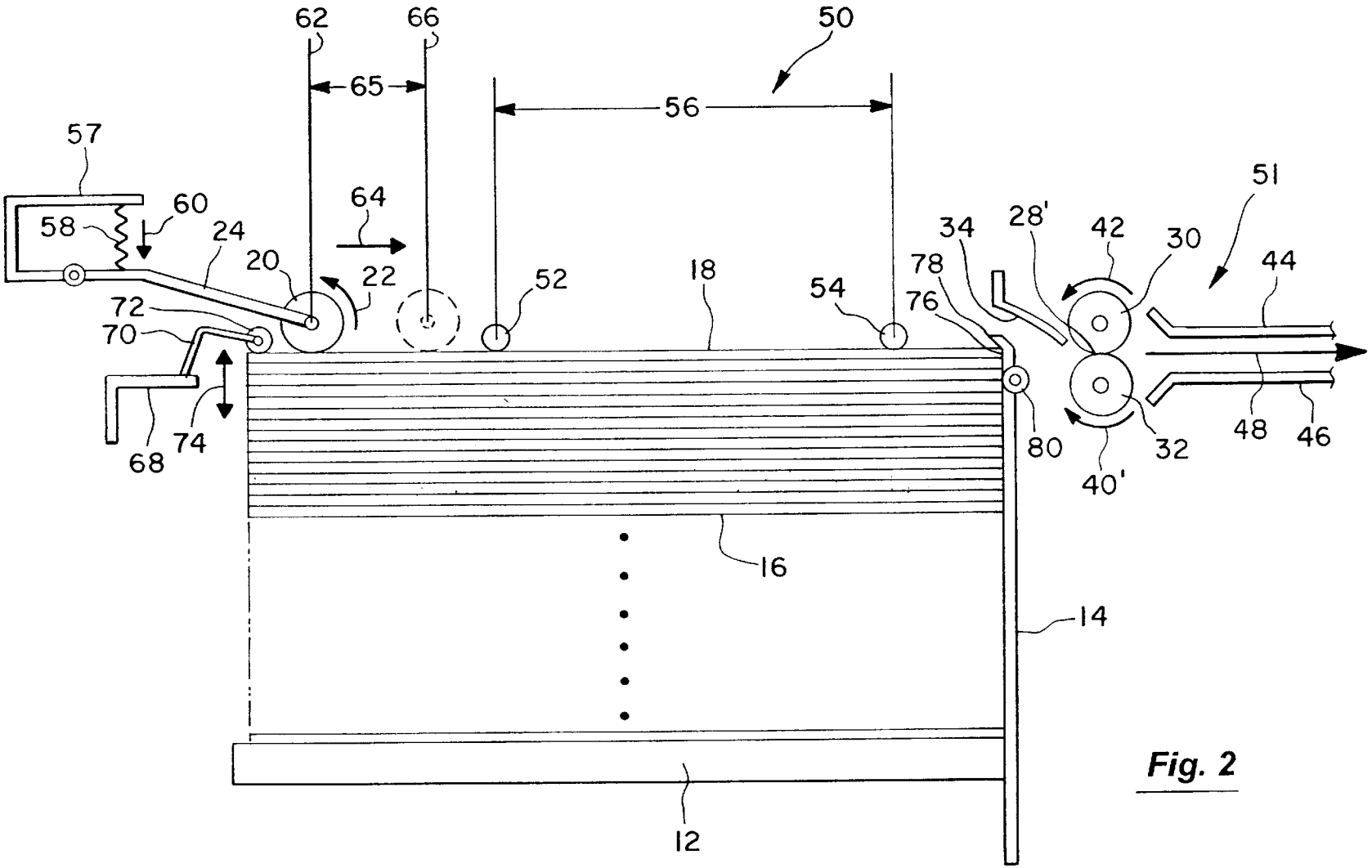
FIG. 2 is a cut-away side view of a sheet feeder of the present patent disclosure in a first operating position.

FIG. 2 depicts a sheet (e.g., paper) separation mechanism 50 made according to the teachings of this patent disclosure. It too is intended to feed successive sheets into a sheet processing device (inkjet printer, electrophotographic printer, impact printer, scanner, facsimile machine, etc.) which is not shown in FIG. 2. This sheet separation mechanism 50 is constructed according to certain teachings of the present patent disclosure, but it has many mechanical features in common with the prior art sheet separation device 10 shown in FIG. 1. Hence, the common elements will carry the same item number designations in FIGS. 2, 3 and 4.

There are, however, several important differences between applicant's sheet separation mechanism and the one depicted in FIG. 1. For example, the sheet separation mechanism 50 shown in FIG. 2 is provided with two sheet elevation stopper bars 52 and 54. These two sheet elevation stopper bars 52 and 54 are preferably located just above (and hence just out of physical contact with) the top sheet 18 of the stack 16 of print media. In FIG. 2, the respective ends of the two bars 52 and 54 are shown separated from each other by a distance 56. In some of the more preferred embodiments of this invention, this distance 56 is preferably at least 25% of the length of a sheet (e.g., print media) being processed. In some of the more preferred embodiments of this invention, this distance 56 will be up to about 75% of the length of such a sheet. These two bars 52 and 54 will preferably extend across most of, or all of, the width of the sheets being processed (e.g., across the 8½ inch width of a standard 8½×11 inch sheet of paper).

Applicant's sheet separating device 50 also is provided with a sheet pickup mechanism 57. It has a biasing device such as a spring 58 for urging an arm 24 in the downward 60 direction suggested in FIG. 2. A sheet pickup device (such as a roller 20, foot, pad, etc.) is attached to the other end of the arm 24. Thus, the pickup device is in biased contact with each succeeding top sheet 18 by the downward bias 60 placed on the arm 24. The pickup device 20 is shown in its full rearward (first) operating position 62. The pickup device 20 can be driven in a forward direction 64 to a full forward (second) operating position 66. Thus, a top sheet 18 that is in contact with pickup device 20 can be driven forward (i.e., rightward) by the distance 65 between lines 62 and 66 by the forward, linear movement 64 of the pickup device 20. Preferably, the distance 65 between the rearward position 62 and forward position 66 of the pickup device 20 is between about one tenth and one half the length of the sheet stock being employed.

FIG. 2 also depicts the sheet separation mechanism 50 provided with a sheet stack holder mechanism 68. It includes an arm 70 that leads to a sheet hold down device 72 such as a pad, foot or roller. The sheet stack holder mechanism 68 is capable of the upward and downward motion generally depicted by double headed arrow 74. This upward and downward motion places the sheet hold down device 72 in and out of contact with successive top sheets of the stack 16. Thus, the sheet hold down device 72 can be lifted to allow a top sheet to move forward, and then lowered to hold down all sheets that have not been moved forward.

Another aspect of the overall operation carried out by applicant's sheet separation mechanism 50 involves raising the entire stack 16 as successive top sheets are removed from it. To this end, the stack 16 is raised by a powered lift tray 12 having a motor and a sensor for sensing the top (e.g., sheet 18) of the stack 16. These components are not shown in FIG. 2, but their construction and operation are well known to those skilled in this art. The top sheet sensing operation also can be used to generate electrical signals that operate other components of the sheet separating mechanism 50, including the pickup device 20.

Figure 3:
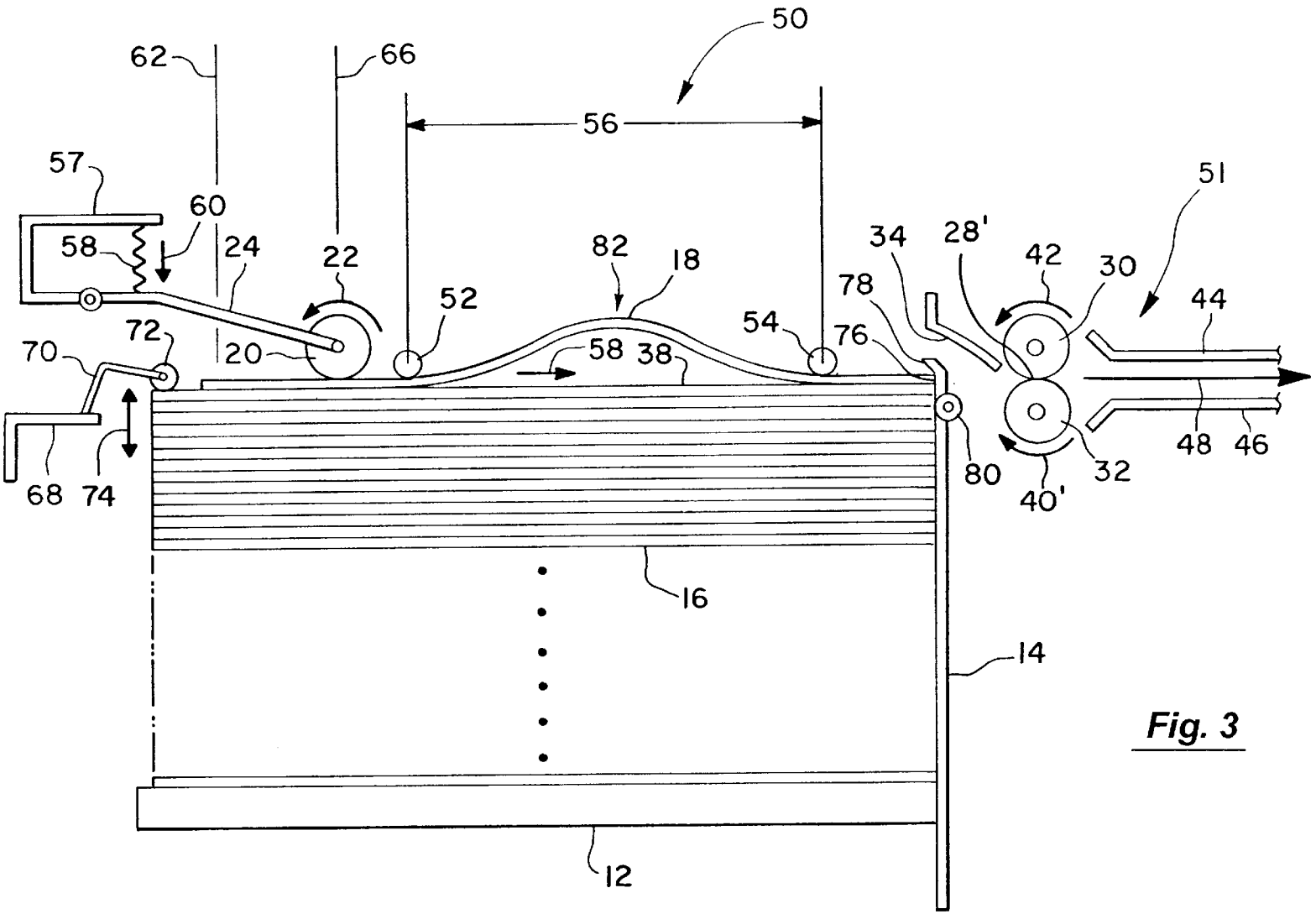
FIG. 3 is a cut-away side view of a sheet feeder of the present patent disclosure in a second operating position.

FIG. 3 shows applicant's pickup device 20 driven to its full forward position 66. The linear movement of the top sheet 18 resulting from the movement of device 20 from its full rearward position 62 to its full forward position 66 can take place independent of any other movement of the sheet contact device e.g., rotation 22 of a sheet pickup device 20 in the form of a powered roller. Such a powered roller is a particularly preferred form of sheet pickup device. Therefore, it also will be designated by item number 20 and used to illustrate a wide variety of such pickup devices. In any case, it also should be understood that the roller 20 shown in FIG. 3 can serve as a sheet contacting (and hence friction-creating) pad or foot that is simply moved linearly from a rearward position 62 to a forward position 66. Preferably, however, such a pickup roller 20 also is capable of powered rotation in the counterclockwise direction 22 indicated. This powered rotation can take place before the roller 20 is moved forward, as it is moved forward and/or after it is moved forward. Be that as it may, as a consequence of one or both of these two sheet moving mechanical actions (i.e., forward movement from rearward position 62 to forward position 66 and/or counterclockwise rotation 22), the front edge 76 of the top sheet 18 is driven into colliding contact with a stopper wall 78. In FIG. 3, this stopper wall 78 is shown attached to a hinge mechanism 80 which, in turn, can be attached to the fixed front wall 14. This colliding action causes a center region 82 of the top sheet 18 to buckle or hump in the upward direction suggested in FIG. 3. This upward sheet buckling or humping action serves to break the top sheet 18 free from underlying sheet 38 if these two sheets happen to be adhering to one another. Successive underlying sheets would likewise be separated. This buckling or humping action is located, defined, guided and limited by the two media elevation stopper bars 52 and 54. In other words, these two media elevation stopper bars 52 and 54 serve to create and position a buckled or humped configuration of the top sheet 18 in the region generally located between said media elevation stopper bars 52 and 54. For example, FIG. 3 shows top sheet 18 humped upward in a humped or mound-like configuration over a distance 56 that is generally defined by the distance between elevation stopper bar 52 and elevation stopper bar 54. Again, this distance 56 can be from about 25% to about 75% of the length of a print media being employed (e.g., 25% to 75% of 11 inches in the case of a standard sheet of 8½×11 inch paper). Distances 56 of 25% to 50% are even more preferred in the case of 8½×11 inch paper. It also should be appreciated that the height of the center region 82 of such a hump will be a function of the distance (from line 62 to line 66) roller 20 moves and/or the total angular rotation of said roller 20 in direction 22.

Either or both of these mechanical actions creates a hump that serves to separate any underlying sheet (e.g., sheet 38) that may be adhering to the underside of the top sheet 18. Hence, misfeeds wherein two or more sheets are fed into the roller device 30/32 are thwarted. It also should be understood that this sheet humping action can be used in place of various prior art misfeed prevention apparatus. For example, it an be used in place of the counterclockwise rotating retard roller 32 movement discussed with respect to the prior art system shown in FIG. 1. Applicant's feeder device 50 can, however, also be used in addition to various prior art sheet separation devices such as the counterclockwise rotating retard roller 32 shown in FIG. 1. Thus, in such an augmenting sheet separation role, applicant's sheet separation device would greatly decrease the frequency with which a prior art sheet separating was called upon to perform its misfeed prevention duty. For example, it would greatly reduce the frequency with which the friction producing counterclockwise rotation of the retard roller 32 shown in FIG. 1 would have to be employed.

Next, it should be noted that FIG. 3 depicts applicant's sheet separating mechanism 50 associated with a sheet takeup device 51 that includes a feed roller 30/retard roller 32 system comparable to that discussed with respect to FIG. 1. It also should be appreciated that such a sheet takeup device 51 may be physically attached to and operate in conjunction with (and hence be an integral part on applicant's sheet separating mechanism 50. Conversely, the sheet takeup device 51 shown in FIG. 3 also may be completely separate and distinct from the sheet separating mechanism 50 of this patent disclosure. Thus, applicant's sheet separating mechanism 50 may be thought of as terminating at the wall 14 and the sheet stopper device 78 attached to said wall 14 by a hinge device 80. Thus, the sheet takeup mechanism 51 can be thought of all those mechanical elements to the right of the stopper wall 78. In turn, the sheet takeup device 51 also may be physically attached to a machine for producing or reproducing hard copy documents (e.g., inkjet printers, electrophotographic printers, copiers, facsimile machines, scanners, etc.) and otherwise functionally operating in conjunction with said machine.

Again, the stopper wall 78 is provided with a swivel or hinge mechanism 80. This hinge mechanism 80 allows said stopper wall 78 to have a substantially vertical orientation such as that shown in FIG. 3, or a substantially horizontal orientation such as that shown in FIG. 4. Thus, when a forwardly driven top sheet 18 encounters the vertically oriented stopper wall 78 (as depicted in FIG. 3), said top sheet 18 is buckled or humped upward between bars 52 and 54. Again this buckling or humping action serves to break the top sheet 18 away from the next underlying sheet 38 if these two sheets happen to be held together by those forces (e.g., electrostatic, friction, chemical surface tension phenomena, edge debris adhesion, etc.) that typically cause multi-sheet misfeeds.

Figure 4:
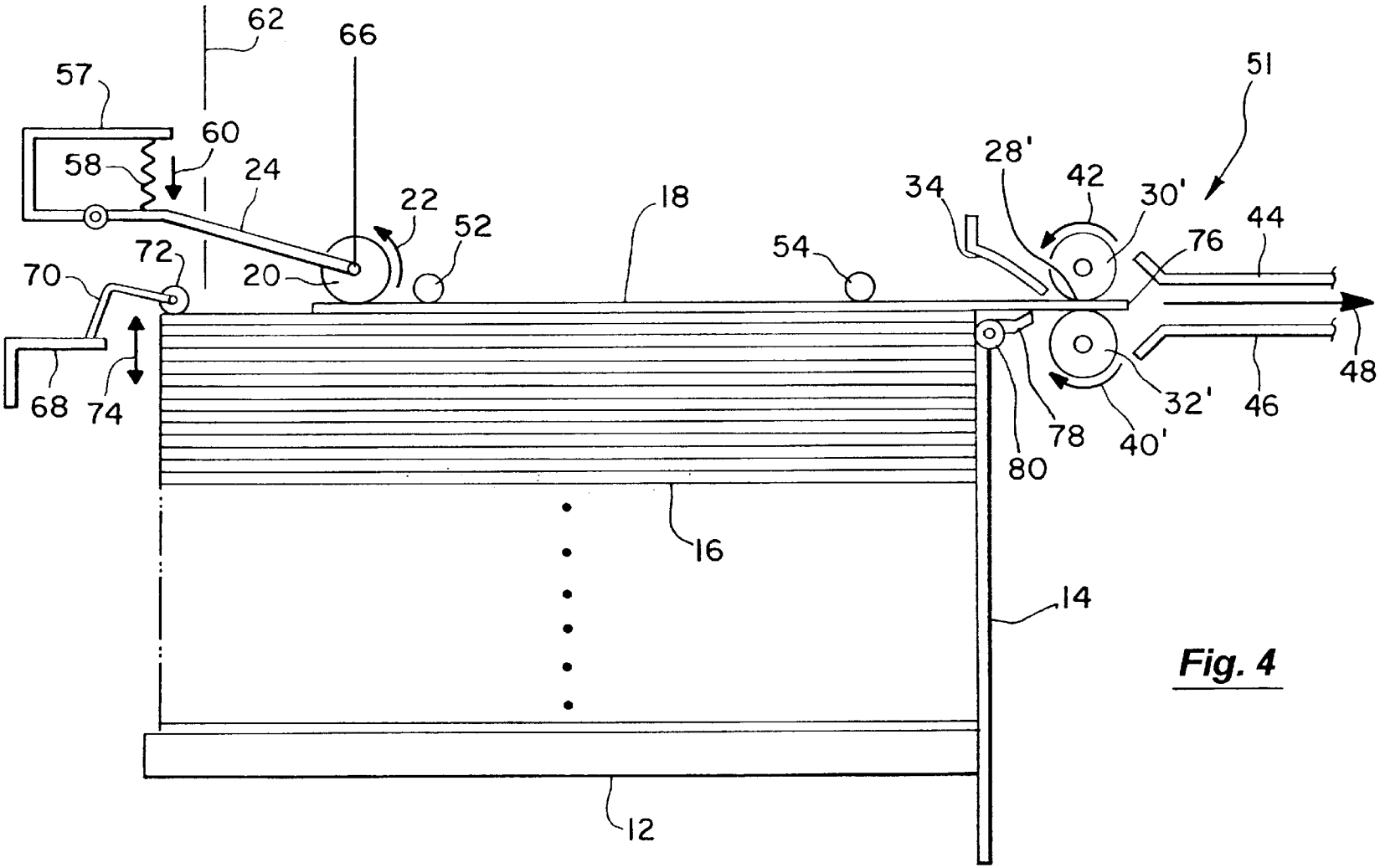
FIG. 4 is a cut-away side view of a sheet feeder of the present patent disclosure in a third operating position.

FIG. 4 shows the next step in the sheet separating process carried out by applicant's invention. In this next step, the hinge or swivel 80 that is attached to the stopper wall 78 is activated in such a manner that it is rotated (e.g., about 90°) in a clockwise direction such that it no longer opposes the leading edge 76 of the top sheet 18 as it did in the step depicted in FIG. 3. In this horizontal orientation, the stopper wall 78 also can serve to guide the leading edge 76 of the top sheet 18 into the nip 28. In any case, when the stopper wall 78 no longer opposes the top sheet 18, said sheet straightens out under the mechanical action delivered by an unbuckling of the sheet itself. This unbuckling of the top sheet will cause its leading edge 76 to move forward into the nip 28' created between drive roller 30' and roller 32'. This forward movement of the leading edge 76 of the top sheet 18 may be (but need not be) assisted by further rightward movement of the pickup roller 20 and/or additional counterclockwise motion 22 of said roller 20.

FIG. 4 is also intended to suggest that the nip 28' between rollers 30' and 32' also can be (but need not be) qualitatively different from the nip 28 of the prior art paper feed device 10 shown in FIG. 1. It can differ because the roller 32' shown in FIG. 4 can be made to always rotate in a clockwise direction 40'. Thus, the counterclockwise rotation 42 of the drive roller 30' and the clockwise rotation 40' of roller 32' are always in mechanical harmony (i.e., going in the same forward motion creating direction 26 and 48) as they create their nip 28'. This circumstance is to be contrasted with the counterclockwise rotation 40 of the retard roller 32 shown in FIG. 1 when a misfeed occurs. Thus, the leading edge 76 of top sheet 18 is fed (under the guiding action of paper path guide 34 and stopper wall 78) into a nip 28' wherein both rollers (30' and 32') are rotating in respective directions that mechanically harmonize with each other to draw the sheet of paper into the nip 28' and through a sheet guiding mechanism 44 and 46 of the sheet takeup device 51 in the forward (rightward) direction 48 indicated in FIG. 4. The fact that these two rollers 30' and 32' roll in mechanical harmony serves to reduce the wear on their roller surfaces relative to the situation depicted in FIG. 1 wherein the retard roller 32 thwarts entry of an underlying sheet 38 (adhering to the underside of a top sheet 18) by rotating in a direction 40 (counterclockwise) that serves to force an underlying sheet 38 in a direction that is the opposite of the desired forward (i.e., rightward) direction 48. In the alternative, however, applicant's sheet separation device can be employed in addition to a prior art sheet separation device such as that shown in FIG. 1. Again, when so employed, applicant's sheet separating device 50 would greatly decrease the number of times an upstream sheet takeup device 51 would be called upon to reject an underlying sheet. Obviously, this circumstance would serve to extend the useful life of takeup device 51.

In either case, once the top sheet 18 shown in FIG. 4 is fed into the rollers 30 and 32, the pickup mechanism 57 begins a rearward or leftward retracting motion that carries the pickup roller 20 from its full forward position 66 back to its original, or full rearward, position 62. After the trailing edge of sheet 18 has cleared the horizontally oriented stopper wall 78, said stopper wall 78 is rotated counterclockwise (e.g., about 90°) to its previous vertical orientation (as seen in FIG. 2). Thus, it is again in position to oppose forward motion of the next top sheet (and therefore buckle it in the same manner experience by the previous top sheet). The stack holder 72 also is released from contact with a succeeding top sheet of the stack 16 and the pickup mechanism 57 is again ready to feed a succeeding topmost sheet (e.g., former underlying sheet 38 has now become the new topmost sheet 18) in the forward direction 64 shown in FIG. 2.

Although specific embodiments of this invention have been illustrated by the preceding drawings and discussions, it is to be understood that this was for purposes of example only. Hence, the drawings and discussions should not be construed as limiting the scope of this invention. That is to say that the herein described sheet separating mechanism may be changed in various ways in order to adapt it to particular applications without departing from the scope of the following claims.

What is claimed is:

1. A sheet separating mechanism comprising:

a tray for containing a stack of sheets;

a pickup for driving a top sheet of the stack forward;

a stopper wall capable of being placed in a substantially vertical orientation and in a substantially horizontal orientation; and a first sheet elevation stopper bar and a second sheet elevation stopper bar for defining a hump in the top sheet by virtue of said sheet being driven forward by the pickup while being opposed by the stopper wall while in its vertical orientation.

2. The sheet separating mechanism of claim 1 wherein the first and second stopper bars are distanced from each other by a distance equal to from about 25 percent to about 75 percent of the length of a sheet being processed by said mechanism.

3. The sheet separating mechanism of claim 1 wherein the pickup moves forward from a rearward position to a forward position over a distance of from about one tenth to about one half of the length of a sheet being processed by said mechanism.

4. The sheet separating mechanism of claim 1 adapted and arranged to operate upon successive sheets of paper.

5. The sheet separating mechanism of claim 1 wherein the pickup is a powered roller.

6. The sheet separating mechanism of claim 1 wherein the pickup is a powered roller that operates before the top sheet is driven forward by the pickup.

7. The sheet separating mechanism of claim 1 where in the pickup is a powered roller that operates while the top sheet is driven forward by the pickup.

8. The sheet separating mechanism of claim 1 wherein the pickup is a powered roller that operates after the top sheet is driven forward by the pickup.

9. The sheet separating mechanism of claim 1 further comprising a stack holder that is in contact with a remainder of the stack when the top sheet is being driven forward by the pickup.

10. The sheet separating mechanism of claim 1 further comprising a powered lift tray whose upward movement is controlled by a sensing device.

11. The sheet separating mechanism of claim 1 further comprising a sheet takeup device having a first roller that rotates in a counterclockwise direction and a second roller that rotates in a clockwise direction.

12. The sheet separating mechanism of claim 1 further comprising a sheet takeup device having a first roller that rotates in a counterclockwise direction and a second roller that is capable of rotating in a counterclockwise direction in the event of a multiple sheet misfeed into a nip of said first and second rollers.

13. A print media separating mechanism comprising:

a tray for containing a stack of print media;

a pickup roller device for driving a top sheet of the stack of print media forward;

a stopper wall capable of being placed in a substantially vertical orientation and in a substantially horizontal orientation;

a first print media elevation stopper bar and a second print media elevation stopper bar for defining a hump in the top sheet of said print media by virtue of its being driven forward by the pickup roller device while being opposed by the stopper wall while in its vertical orientation;

a sheet take-up device into which the top sheet of print media is fed when the stopper wall is in its substantially horizontal orientation;

a sheet holder capable of being placed in and out of contact with successive top sheets in the stack of print media, and a powered lift tray for raising the stack of print media as successive sheets of said print media are removed from said tray.

14. The print media separating mechanism of claim 13 wherein the first and second stopper bars are distanced from each other by a distance equal to from about 25 percent to about 50 percent of the length of a sheet of print media being processed by the print media separating mechanism.

15. The print media separating mechanism of claim 13 wherein the pickup moves from a rearward position to a forward position over a distance of from about one tenth to about one half of the length of a sheet of print media processed by said mechanism.

16. The print media separating mechanism of claim 13 the pickup roller device is capable of powered rotation.

17. The print media separating mechanism of claim 13 which further comprises a sheet takeup device having first roller that rotates in a counterclockwise direction and a second roller that is capable of rotating in a counterclockwise direction in the event of a multiple sheet misfeed into a nip between said first and second rollers.

18. A paper separation mechanism comprising:

a powered tray for containing and lifting a stack of paper;

a powered roller pickup for driving a top sheet of the stack of paper forward;

a stopper wall capable of being placed in a substantially vertical orientation and in a substantially horizontal orientation; and a first paper elevation stopper bar and a second paper elevation stopper bar for defining a hump in the top sheet of paper by virtue of said top sheet of paper being drive forward by the pickup while being opposed by the stopper wall while in its vertical orientation.

19. The paper separation mechanism of claim 18 further comprising a paper take-up device into which the top sheet of paper is fed while the stopper wall is in its substantially horizontal orientation.

20. The paper separation mechanism of claim 18 adapted and arranged to process standard 8½×11 inch sheets of paper.

* * * * *